US008598802B2

(12) United States Patent
Huang et al.

(10) Patent No.: US 8,598,802 B2
(45) Date of Patent: Dec. 3, 2013

(54) TRIAC DIMMER COMPATIBLE WLED DRIVING CIRCUIT AND METHOD THEREOF

(75) Inventors: Yong Huang, Hangzhou (CN); Lei Du, Hangzhou (CN)

(73) Assignee: Monolithic Power Systems, Inc., San Jose, CA (US)

( * ) Notice: Subject to any disclaimer, the term of this patent is extended or adjusted under 35 U.S.C. 154(b) by 406 days.

(21) Appl. No.: 12/955,364

(22) Filed: Nov. 29, 2010

(65) Prior Publication Data

US 2011/0127925 A1 Jun. 2, 2011

(30) Foreign Application Priority Data

Nov. 30, 2009 (CN) ..... 2009 1 0310660

(51) Int. Cl.
*H05B 41/24* (2006.01)

(52) U.S. Cl.
USPC ..... 315/287; 314/291; 314/302

(58) Field of Classification Search
USPC ..... 315/291, 194, 209 R, 224, 246, 247, 315/212, 219, 254, 266, 272, 274, 276, 279, 315/287, 302
See application file for complete search history.

(56) References Cited

U.S. PATENT DOCUMENTS

| | | | | |
|---|---|---|---|---|
| 8,278,832 | B2 * | 10/2012 | Hung et al. | 315/219 |
| 2007/0182347 | A1 * | 8/2007 | Shteynberg et al. | 315/312 |
| 2009/0261744 | A1 * | 10/2009 | Chen et al. | 315/199 |
| 2010/0123410 | A1 * | 5/2010 | Tsai | 315/287 |

* cited by examiner

*Primary Examiner* — Jimmy Vu
*Assistant Examiner* — Henry Luong
(74) *Attorney, Agent, or Firm* — Perkins Coie LLP

(57) ABSTRACT

The present technology is generally related to Triac dimmer compatible driving circuits and methods thereof. The present technology also provides an electronic transformer that is integrated in the Traic dimmer compatible driving circuit. In one embodiment, the electronic transformer detects the conduction angles of an output AC voltage from the Triac dimmer and converts said output AC voltage into a PWM DC voltage having a duty cycle regulated by said conduction angles. Said PWM DC voltage is then applied to a WLED driver for driving a WLED.

14 Claims, 4 Drawing Sheets

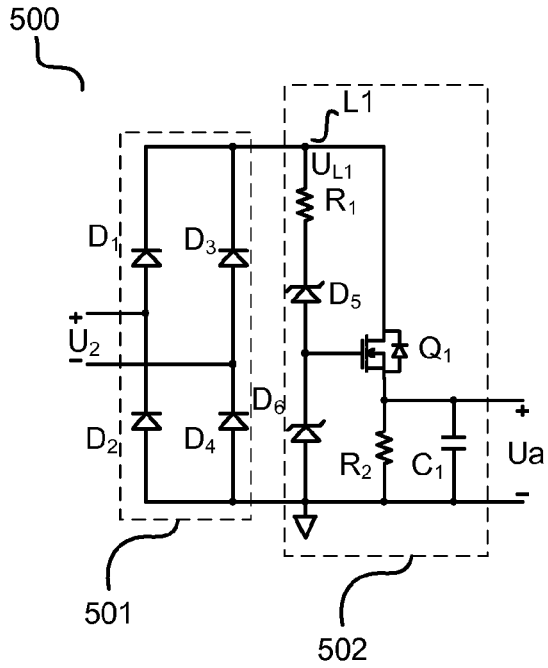
*FIG. 5*
*FIG. 6A*
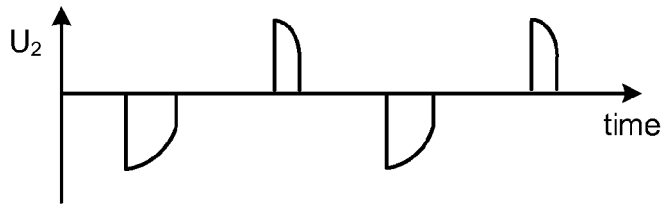
*FIG. 6B*
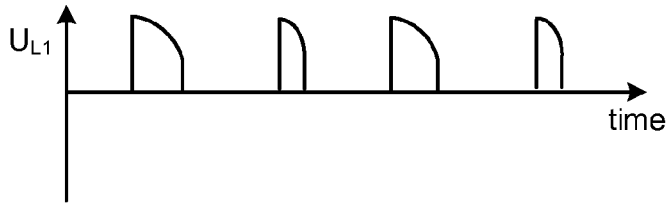
*FIG. 6C*
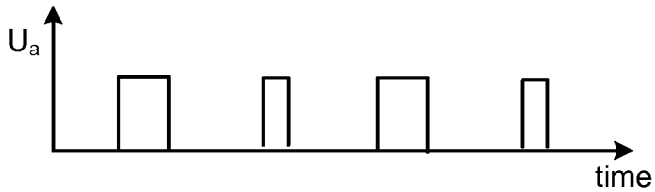

TRIAC DIMMER COMPATIBLE WLED DRIVING CIRCUIT AND METHOD THEREOF

CROSS REFERENCE TO RELATED APPLICATIONS

The present application claims priority to and the benefit of Chinese Patent Application No. 200910310660.9, filed Nov. 30, 2009, the disclosure of which is incorporated herein by reference in its entirety.

TECHNICAL FIELD

The present technology generally relates to circuits and methods for driving light emitting diodes ("LEDs"), and in particular, relates to circuits and methods for driving white LEDs ("WLEDs") with Triac dimmer used for realizing the dimming function.

BACKGROUND

Currently, one major trend of WLED application is to replace existing traditional lamps. One problem to solve is to achieve smooth dimming of WLED with standard Triac dimmers which are conventionally designed for pure resistive lamp loads, such as incandescent or halogen light bulbs.

However, WLED does not appear as a resistive load to the Triac dimmer. Thus, when dimming WLED with conventional Triac dimmer, the dimming performance is often unsatisfactory. FIG. 1 illustrates a block diagram of a prior art driving circuit that applies the conventional driving system for a resistive lamp with Triac dimming to drive a WLED. The driving system 100 comprises: a Triac dimmer 101, an electronic transformer 103, a rectifier 105 and a WLED driver 107, for driving the WLED 109. Triac dimmer 101 regulates the power delivered from an AC power supply (usually 110V-220V) to the driving system 100 by monitoring the on time of its internal Triac, and outputs a high AC voltage having regulated conduction angles. A conduction angle represents the on time of said Triac in a cycle in degrees or radians.

Generally, a control signal is provided to turn on the Triac and a current will flow through it. When said current flowing through the Triac decreases to a determined value, the Triac turns off automatically. Electronic transformer 103 receives said high AC voltage and converts it into a low AC voltage. Rectifier 105 rectifies said low AC voltage and generates a low DC voltage to power said WLED driver 107 which drives the WLED in operation. As discussed in more detail below, several characteristics of the foregoing operation can cause the WLED to flicker. Accordingly, several improvements in circuits and methods for driving WLEDs may be desirable.

BRIEF DESCRIPTION OF THE DRAWINGS

The following detailed description of the embodiments of the present disclosure can best be understood when read in conjunction with the following drawings, in which the features are not necessarily drawn to scale but rather are drawn as to best illustrate the pertinent features, wherein:

FIG. 5 illustrates an exemplary implementation circuitry of the conduction angle detection module according to one embodiment of the present disclosure.

FIG. 6*a*-FIG. 6*c* illustrate various operation waveforms of the circuit shown in FIG. 5.

DETAILED DESCRIPTION

Various embodiments of the technology will now be described. In the following description, some specific details, such as example circuits and example values for these circuit components, are included to provide a thorough understanding of embodiments of the technology. One skilled in the relevant art will recognize, however, that the technology can be practiced without one or more specific details, or with other methods, components, materials, etc. In other instances, well-known structures, materials, or operations are not shown or described in detail to avoid obscuring aspects of the technology.

Figure 1:
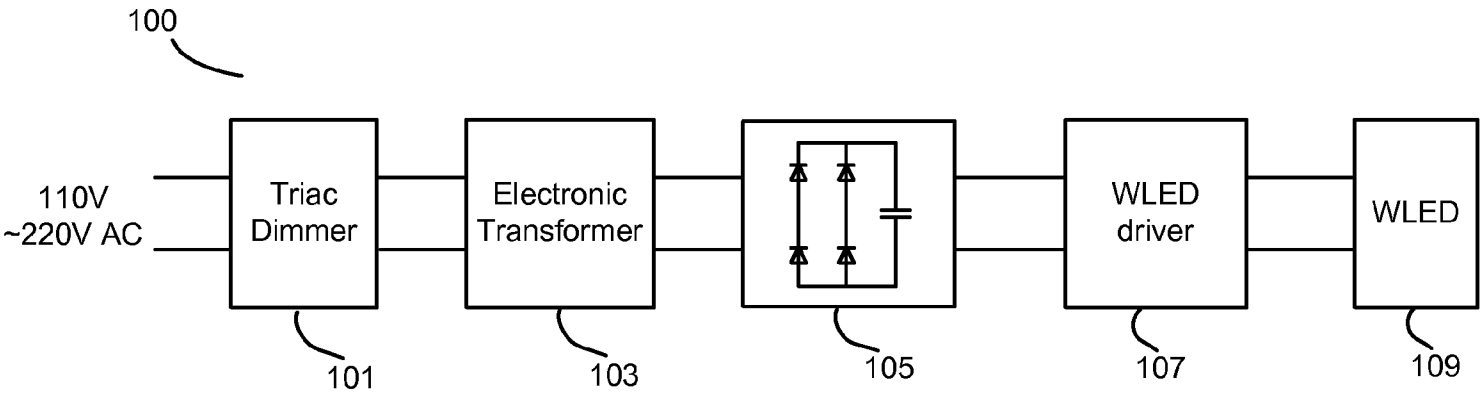
FIG. 1 (Prior Art)
FIG. 1 illustrates a block diagram of a prior art driving circuit of a WLED.

Several embodiments of the present technology are directed to Triac dimmer compatible WLED driving circuits that can address asymmetrical AC voltage generation and/or lost conduction angle in conventional Triac dimmer circuits. Referring to FIG. 1, during a dimming process, the high AC voltage generated from the Triac dimmer 101 is often asymmetrical. Therefore, the low AC voltage generated from the electronic transformer 103 is also asymmetrical. Consequently, the DC voltage output from the rectifier may contain low frequency AC voltage ripples.

In addition, if some of the conduction angles are lost during the dimming process, the DC voltage generated from the rectifier 105 may further contain low frequency voltage ripples with frequencies lower than 50 Hz. Without being bound by theory, it is believed that a conduction angle may be lost during a cycle if the control signal comes late. For example, if the control signal comes nearly at the end of the cycle, the Triac may not have sufficient time to be fully turned on and consequently the conduction angle which should have represented the short conduction time in this case maybe lost. The low DC voltage that contains the low frequency AC voltage ripples, when supplied to the WLED driver 107, may cause the WLED 109 to be flickering during the dimming process.

Figure 2:
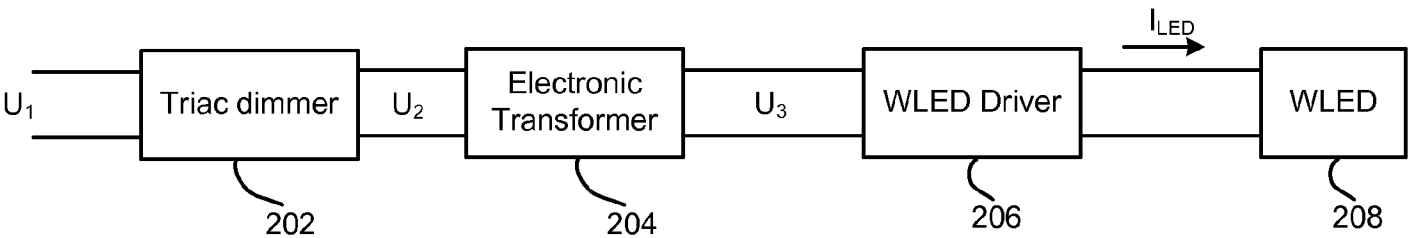
FIG. 2 illustrates a block diagram of a Triac dimmer compatible WLED driving circuit in accordance with one embodiment of the present disclosure.

FIG. 2 illustrates a block diagram of a Triac dimmer compatible WLED driving circuit 200 in accordance with one embodiment of the present disclosure. The driving circuit 200 comprises a Triac dimmer 202, for receiving a high AC supply voltage U1 and generating a high AC voltage U2 having regulated conduction angles; an electronic transformer 204, for detecting said conduction angles of said high AC voltage U2 and converting said high AC voltage U2 into a pulse width modulated (PWM) low DC voltage U3 whose duty cycle is regulated by said conduction angles; and a WLED driver 206, for receiving said PWM low DC voltage U3 and providing a driving current $I_{LED}$ which drives a WLED 208 in operation.

Figure 3:
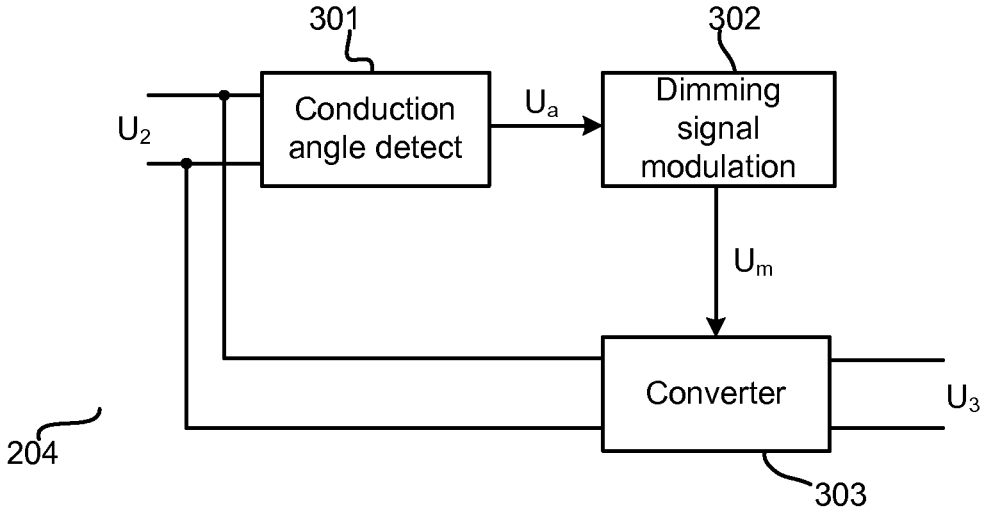
FIG. 3 illustrates a block diagram of an electronic transformer according to one embodiment of the present disclosure.

FIG. 3 illustrates a block diagram of electronic transformer 204 according to one embodiment of the present disclosure. As shown, electronic transformer 204 comprises at least a conduction angle detection module 301, coupled to said Triac dimmer 202 for receiving said high AC voltage U2 and generating a first PWM signal Ua representing the conduction angles of said high AC voltage U2; a conduction angle modulation module 302, coupled to conduction angle detection module 301 for receiving and low pass filtering said first PWM signal Ua to generate a DC voltage signal $U_{dc}$, comparing said DC voltage signal $U_{dc}$ with a triangle waveform and generating a second PWM signal Um; a conversion module 303, coupled to Triac dimmer 202 and to conduction angle modulation module 302, for receiving respectively said high AC voltage U2 and said second PWM signal Um therefrom, and converting said high AC voltage U2 into said PWM low DC voltage U3 in response to said second PWM signal Um.

Figure 4A:
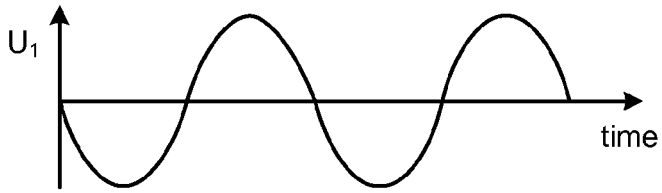
FIG. 4*a*-FIG. 4*g* illustrate various operation waveforms of the circuit shown in FIG. 2.
Figure 4B:
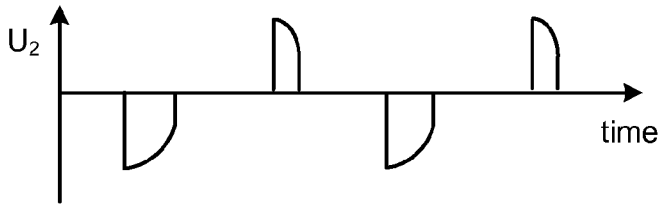
Figure 4C:
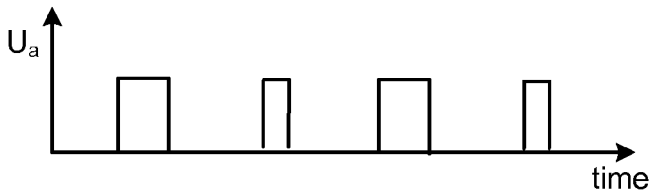

As illustrated in FIG. 4*a* to FIG. 4*c* are some of the waveforms of the Triac dimmer compatible WLED driving circuit 200 in normal operation. In the following, working principles of the Triac dimmer compatible WLED driving circuit 200 is addressed with reference to FIG. 4*a* to FIG. 4*c*.

During a dimming process, Triac dimmer 202 receives the high AC supply voltage U1 (FIG. 4*a*) and regulates the same to deliver power to said driving circuit 200 during the on time of the Triac in a supply cycle. Generally, the Triac is turned on by a control signal, which allows a current to flow through it, and is turned off automatically when said current flowing through the Triac decreases to a predetermined value. The on time of said Triac in a supply cycle presented in degrees or radians is referred to as a conduction angle in this disclosure. Therefore, said Triac dimmer 202 regulates said high AC supply voltage U1 and outputs said high AC voltage U2 (FIG. 4*b*) with conduction angles regulated.

Figure 4D:
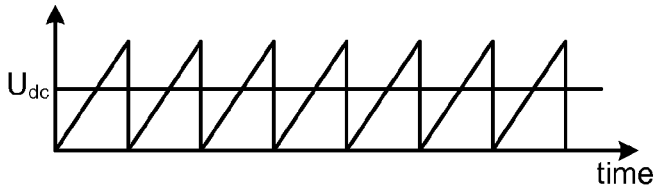

Electronic transformer 204 detects said conduction angles via said conduction angle detection module 301 and generates said first PWM signal Ua (FIG. 4*c*), wherein the frequency and the duty cycle of said first PWM signal Ua is the same as or at least generally similar to those of said conduction angles. Said first PWM signal Ua is subsequently fed to said conduction angle modulation module 302 and low pass filtered so that a DC voltage signal $U_{dc}$ (FIG. 4*d*) which represents the DC average value of said first PWM signal Ua is obtained.

Figure 4E:
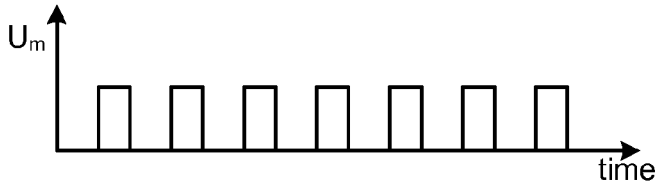
Figure 4F:
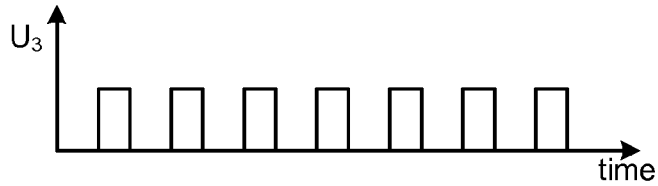

Comparing said DC voltage signal $U_{dc}$ with a triangle waveform, a second PWM signal Um (FIG. 4*e*) is generated whose duty cycle is modulated by said conduction angles and whose frequency is higher than that of the conduction angles. Said second PWM signal Um is then provided to said conversion module 303 in order to control said conversion module 303 to convert said high AC voltage signal U2 into said PWM low DC voltage U3 (FIG. 4*f*) whose duty cycle and frequency are in accordance with those of said second PWM signal Um. Thus, the conduction angles of said high AC voltage U2 are reflected in the duty cycle of said PWM low DC voltage U3, which is regulated in amplitude at a predetermined voltage level, for example 12V, and powers said WLED 206 driver.

Figure 4G:
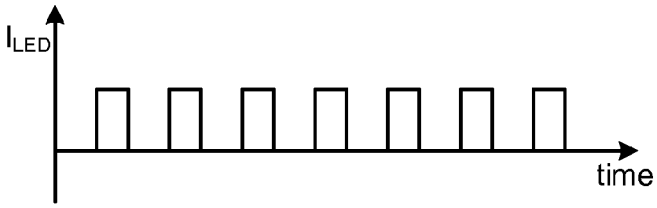

Said WLED driver 206 drives said WLED 208 with constant current when said PWM low DC voltage U3 is in a high level, and does not supply current to said WLED 208 when said PWM low DC voltage U3 is in low level. Current ($I_{LED}$) flowing through WLED 208 is illustrated in FIG. 4*g*. Therefore, according to the present disclosure, by monitoring said Triac dimmer 202 which generates a high AC voltage U2 with conduction angles regulated, the electronic transformer 204 can output a PWM low DC voltage U3 with duty cycle modulated by said conduction angles, which controls the WLED driver 206 to provide regulated average current to the WLED 208, achieving the brightness regulation (dimming) of WLED 208.

According to the present disclosure, said PWM low DC voltage U3 from the electronic transformer 204 has a frequency and a duty cycle that are the same as or at least generally similar to those of said second PWM signal Um, thus, the frequency of said PWM low DC voltage U3 is higher than that of the conduction angles. Therefore, said PWM low DC voltage U3 generally does not contain low frequency AC voltage ripples that are of frequency of 50 Hz or lower, which at least reduces the risk of flicking by the WLED 208 during the dimming process. As such, embodiments of the Triac dimmer compatible driving circuit 200 and associated methods thereof can achieve smooth dimming for WLEDs with satisfactory dimming performance.

According to one embodiment of the present disclosure, said conduction angle detection module 301 can be implemented by a circuitry 500 comprising a rectifier circuit 501 and an analogous linear regulator circuit 502 as illustrated in FIG. 5. Rectifier circuit 501 comprises four high voltage diodes D1, D2, D3 and D4, and receives said high AC voltage U2. Serially connected diodes D1 and D2 and serially connected diodes D3 and D4 are coupled in parallel between node L1 and ground, with the cathodes of D1 and D3 coupled to node L1. The anodes of D2 and D4 are coupled to ground, and the anode of D1 and the cathode of D2 coupled to one polarity of said high AC voltage U2. The anode of D3 and the cathode of D4 are coupled to the other polarity of said high AC voltage U2.

Analogous linear regulator circuit 502 comprises a first resistor R1, a first Zener diode D5, a second Zener diode D6, a transistor Q1, a second resistor R2 and a capacitor C1. Said first resistor R1 is coupled to node L1 at one terminal and to the cathode of said first Zener diode D5 at the other terminal; the anode of said first Zener diode D5 is coupled to the cathode of said second Zener diode D6 and the gate terminal of said transistor Q1; the anode of said second Zener diode D6 is coupled to ground; the drain terminal of said transistor Q1 is coupled to node L1 and the source terminal of said transistor Q1 is coupled to ground via said second resistor R2 and said capacitor C1 which are coupled in parallel.

The source terminal of transistor Q1 is configured as the output terminal of said circuitry 500. In operation, rectifier circuit 501 converts the original negative part of said high AC voltage U2 (FIG. 6*a*) into a positive form while maintains the original positive part unchanged, resulting in a voltage UL1 (FIG. 6*b*) being applied to node L1. Analogous linear regulator circuit 502 is then powered by said line voltage UL1. When the voltage across said first Zener diode D5 reaches its reverse break down voltage, the voltage across said second Zener diode D6 starts to rise. The output voltage Ua (FIG. 6*c*) of conduction angle detection circuitry 500 is equal to the voltage across Zener diode D6 minus the gate to source voltage of transistor Q1. However, since transistor Q1 operates in linear region in this configuration, its gate to source voltage is negligibly small as with the voltage across Zener diode D6. Thus, the voltage Ua is nearly the same as or at least generally similar to the voltage across Zener diode D6.

When the voltage across Zener diode D6 also reaches its reverse break down voltage, it stays at its reverse break down voltage. This allows the voltage Ua to be clamped to a voltage that is nearly of the reverse break down voltage of Zener diode D6, generally the reverse break down voltage of Zener diode D6 minus the gate to source voltage of transistor Q1. The reverse break down voltages of Zener diodes D5 and D6 are typically not very high, and thus are quick to reach, so the rising edge of the voltage Ua is basically in accordance with the moment when the internal Triac of the Triac dimmer 202 is turned on. Similarly, the falling edge of the voltage Ua is basically in accordance with the moment when the internal Triac of the Triac dimmer 202 is tuned off. Thus, the voltage Ua is a pulse signal whose pulse width is in accordance with the ON time of the internal Triac of the Triac dimmer 202, and accordingly implements the detection of conduction angles of said high AC voltage U2.

It should be understood by those skilled in the art that various modifications and variations can be made to circuitry 500, for example, it is possible to remove said first Zener diode D5 without influencing the conduction angle detection function, and it is also possible to replace said transistor Q1 with any other controllable transistor devices, such as a bipolar junction transistor ("BJT").

According to certain embodiments of the present disclosure, it is to be understood by those skilled in the art that a zero cross detection comparator can be used to replace said analogous linear regulator circuit 502 in said circuitry 500. In this case, said zero cross detection comparator receives and processes said line voltage UL1 to generate said first PWM signal Ua so that once said line voltage UL1 is higher than zero, said first PWM signal Ua changes to high level, once said line voltage UL1 falls to or below zero, said first PWM signal Ua changes to low level. In this way, said first PWM signal Ua represents conduction angles of said high AC voltage U2 in its pulse width.

In other embodiments of the present disclosure, said conduction angle detection module 301 comprises a low pass filter and a PWM comparator. Said low pass filter is configured to receive said first PWM signal Ua and convert it into said DC voltage signal $U_{dc}$; said PWM comparator is configured to receive said DC voltage signal $U_{dc}$ and compare it with a triangle signal to generate said second PWM signal Um. In further embodiments of the present disclosure, said converter module can be any AC to DC converter that converts a high AC voltage into a low DC voltage.

The above detailed description of the embodiments of the technology is not intended to be exhaustive or to limit the technology to the precise form disclosed above. While specific embodiments of, and examples for, the technology are described above for illustrative purposes, various equivalent modifications are possible within the scope of the technology, as those skilled in the relevant art will recognize. For instance, while specific component values and voltage values are provided herein, it is to be appreciated that these values are for the sake of illustration and explanation. Various embodiments of the technology may utilize values that are different from what is specified herein.

These modifications can be made to the technology in light of the above detailed description. The terms used in the following claims should not be construed to limit the technology to the specific embodiments disclosed in the specification and claims. Rather, the scope of the technology is to be determined entirely by the following claims, which are to be construed in accordance with established doctrines of claim interpretation.

What is claimed is:

1. A white light emitting diode (WLED) driving circuit, comprising:

a Triac dimmer configured to receive an input alternating current (AC) supply voltage and to provide an output AC voltage having a plurality of regulated conduction angles;

an electronic transformer configured to receive said output AC voltage and to convert said output AC voltage into a pulse width modulation (PWM) direct current (DC) voltage, wherein said PWM DC voltage having a duty cycle;

a WLED driver configured to receive said PWM DC voltage and to provide a WLED driving signal; wherein said electronic transformer detects said plurality of regulated conduction angles of said output AC voltage and regulates the duty cycle of said PWM DC voltage based on said plurality of regulated conduction angles;

a conduction angle detection module configured to detect said plurality of regulated conduction angles of said output AC voltage and generating a first PWM signal representing said plurality of regulated conduction angles;

a conduction angle modulation module configured to receive said first PWM signal, and to generate a DC voltage signal which represents an average DC value of said first PWM signal, and said conduction angle modulation module configured to compare said DC voltage signal with a triangle waveform to generate a second PWM signal having a duty cycle and a frequency; and a conversion module configured to receive said output AC voltage and said second PWM signal, and to convert said output AC voltage into said PWM DC voltage in response to said second PWM signal.

2. The WLED driving circuit of claim 1, wherein, the duty cycle of said second PWM signal is modulated by said plurality of regulated conduction angles.

3. The WLED driving circuit of claim 1, wherein, said conduction angle detection module comprising:

a rectifier circuit configured to receive said output AC voltage and rectifying said output AC voltage into a DC voltage; and an analogous linear regulator circuit, comprising a Zener diode and a controllable switch, wherein, a cathode of said Zener diode is coupled to said DC voltage via a first resistor, and an anode of said Zener diode is coupled to ground; a gate terminal of said controllable switch is coupled to the cathode of said Zener diode, a drain terminal of said controllable switch is coupled to said DC voltage, and a source terminal of said controllable switch which operates as the output terminal of said conduction angle detection module is coupled to ground via a second resistor.

4. The WLED driving circuit of claim 1, wherein, said conduction angle detection module comprising:

a rectifier circuit configured to receive said output AC voltage and rectifying said output AC voltage into a DC voltage; and a zero cross comparator circuit configured to receive and process said DC voltage and generating said first PWM signal; wherein when said DC voltage is higher than zero, said first PWM signal is at a high level, and wherein when said high DC voltage falls to or below zero, said first PWM signal is at a low level.

5. The WLED driving circuit of claim 1, wherein said conduction angle modulation module comprises:

a low pass filter configured to receive said first PWM signal and to convert said first PWM signal into said DC voltage signal; and a PWM comparator configured to receive said DC voltage signal, and wherein said PWM comparator is configured to compare said DC voltage signal to said triangle waveform to generate said second PWM signal.

6. The WLED driving circuit of claim 1, wherein, said conversion module comprises an AC to DC converter.

7. A white light emitting diode (WLED) driving method, comprising:

providing an AC supply voltage to a Triac dimmer and generating an output AC voltage having a plurality of regulated conduction angles;

converting said output AC voltage having said plurality of regulated conduction angles into a pulse width modulation (PWM) direct current (DC) voltage having a duty cycle;

applying said PWM DC voltage to a WLED driver to control said WLED driver to output a WLED driving signal; and detecting said plurality of regulated conduction angles of said output AC voltage and regulating the duty cycle of said PWM DC voltage based on said plurality of regulated conduction angles wherein converting said output AC voltage into said PWM DC voltage comprises:

detecting the plurality of regulated conduction angles of said output AC voltage;

generating a first PWM signal representing the plurality of regulated conduction angles of said output AC voltage;

filtering said first PWM signal to generate a DC voltage signal representing the average DC value of said first PWM signal;

comparing said DC voltage signal with a triangle waveform to generate a second PWM signal; and converting said output AC voltage into said PWM DC voltage in accordance with said second PWM signal.

8. The WLED driving method of claim 7, wherein the duty cycle of said second PWM signal is modulated by said plurality of regulated conduction angles.

9. An electronic transformer for receiving an AC voltage having a plurality of regulated conduction angles, and to provide a PWM DC voltage having a duty cycle, comprising:

a conduction angle detection module configured to detect said plurality of regulated conduction angles of said AC voltage;

a control module configured to regulate said duty cycle of said PWM DC voltage in accordance with the said plurality of regulated conduction angles, wherein said control module comprises a conduction angle modulation module and a conversion module, and further wherein, said conduction angle detection module is configured to provide a first PWM signal based on said plurality of regulated conduction angles detected;

said conduction angle modulation module is configured to receive said first PWM signal and generate a DC voltage signal representing the DC average value of said first PWM signal, and said conduction angle modulation module is configured to said DC voltage signal with a triangle waveform to provide a second PWM signal; and said conversion module is configured to receive said AC voltage and said second PWM signal and convert said AC voltage into said PWM DC voltage in accordance with said second PWM signal.

10. The electronic transformer of claim 9, wherein the frequency and the duty cycle of said first PWM signal are the same as those of said plurality of regulated conduction angles, the duty cycle of said second PWM signal being modulated by said plurality of regulated conduction angles, and the frequency of said second PWM signal being higher than that of said plurality of regulated conduction angles.

11. The electronic transformer of claim 9, wherein said conduction angle detection module comprising:

a rectifier circuit configured to receive said AC voltage and to rectify said AC voltage into a DC voltage;

an analogous linear regulator circuit, comprising a Zener diode and a controllable switch, wherein a cathode of said Zener diode is coupled to said DC voltage via a first resistor, and an anode of said Zener diode is coupled to ground; a gate terminal of said controllable switch is coupled to the cathode of said Zener diode, a drain terminal of said controllable switch is coupled to said DC voltage and a source terminal of said controllable switch which operates as the output terminal of said conduction angle detection module is coupled to ground via a second resistor.

12. The electronic transformer of claim 9, wherein said conduction angle detection module comprises:

a rectifier circuit configured to receive said AC voltage and to rectify said AC voltage into a DC voltage; and a zero cross comparator circuit configured to receive and process said DC voltage and to generate said first PWM signal; wherein when said DC voltage is higher than zero, said first PWM signal is at a high level, and wherein when said DC voltage falls to or below zero, said first PWM signal is at a low level.

13. The electronic transformer of claim 9, wherein said conduction angle modulation module comprises:

a low pass filter configured to receive and convert said first PWM signal into said DC voltage signal; and a PWM comparator configured to receive said DC voltage signal and to compare said DC voltage signal with said triangle waveform to generate said second PWM signal.

14. The electronic transformer of claim 9, wherein said conversion module comprises an AC to DC converter.

* * * * *